US005372020A

United States Patent [19]

Stoltz et al.

[11] Patent Number: 5,372,020

[45] Date of Patent: Dec. 13, 1994

[54] THEFT DETERRENT RELEASE DEVICE

[75] Inventors: Klas Stoltz; Bo Gustavsson, both of Huddinge, Sweden

[73] Assignee: Fargklamman Svenska AB, Huddinge, Sweden

[21] Appl. No.: 36,861

[22] Filed: Mar. 25, 1993

[30] Foreign Application Priority Data

Apr. 7, 1992 [SE] Sweden ..... 9201098-2

[51] Int. Cl.[5] ..... E05B 65/00

[52] U.S. Cl. ..... 70/57.1; 70/61

[58] Field of Search ..... 24/704.1; 70/57, 58, 70/57.1, 62, 61; 248/551

[56] References Cited

U.S. PATENT DOCUMENTS

| | | | |
|---|---|---|---|
| 3,858,280 | 1/1975 | Martens | 70/57.1 |
| 4,012,813 | 3/1977 | Martens et al. | 70/57.1 |
| 4,353,521 | 10/1982 | Webb | 248/551 |
| 4,502,717 | 3/1985 | Close | 70/57.1 |
| 4,527,310 | 7/1985 | Vandebult . | |
| 4,603,829 | 8/1986 | Koike et al. | 70/58 |
| 4,651,136 | 3/1987 | Anderson et al. | 70/57.1 |
| 5,069,047 | 12/1991 | Lynch et al. | 70/57.1 |
| 5,255,543 | 10/1993 | Wittman | 70/57.1 |

*Primary Examiner*—Peter M. Cuomo
*Assistant Examiner*—Darnell M. Boucher
*Attorney, Agent, or Firm*—Browdy and Neimark

[57] ABSTRACT

The present invention relates to a release device for releasing theft deterrents from theft attractive goods. The release device includes a deterrent detaching element (2) having a release part (6) which is adapted to the theft deterrent concerned and which has a release function. The device also includes a mount (4), which is firmly secured to an underlying support surface. The theft detaching element (2) can be locked in the mount (4) in two alternative positions, of which one position enables activation of the release function, whereas the other position prevents activation of the release function.

10 Claims, 2 Drawing Sheets

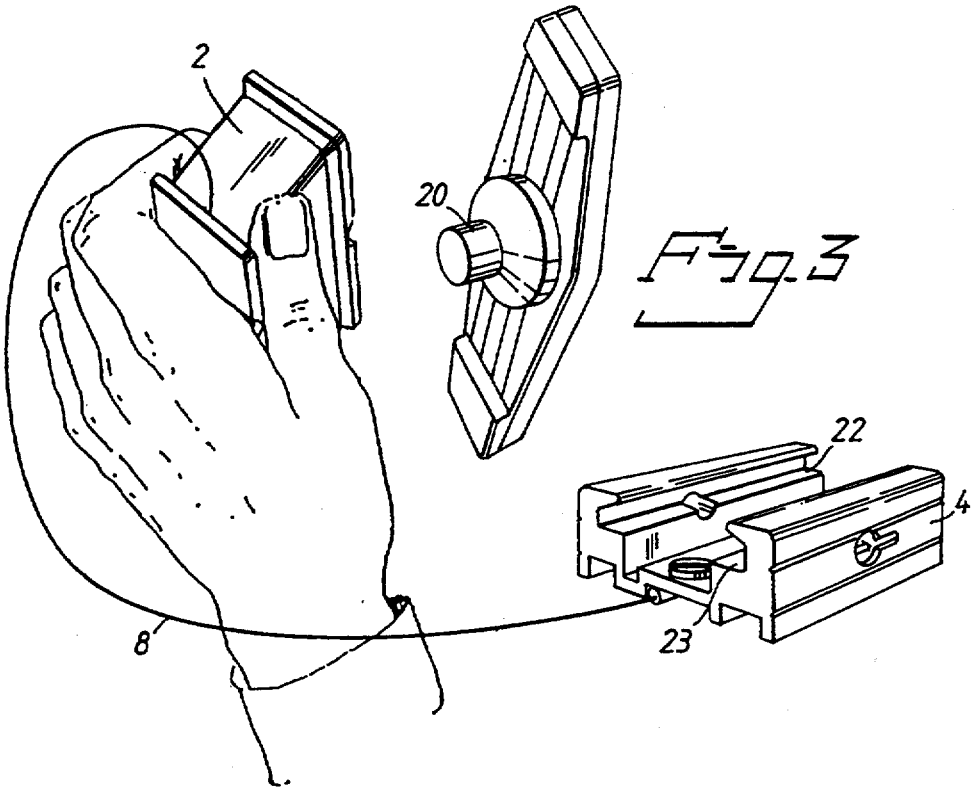
Fig. 3
Fig. 4
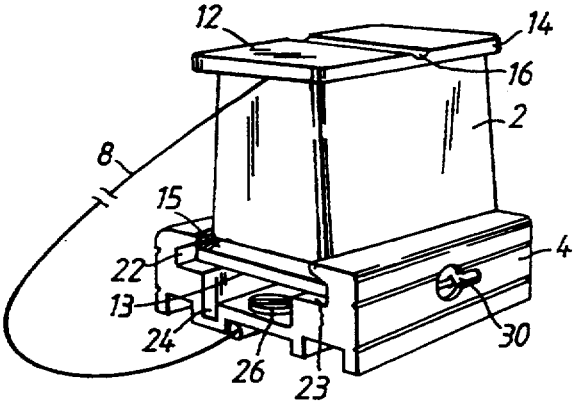
Fig. 5
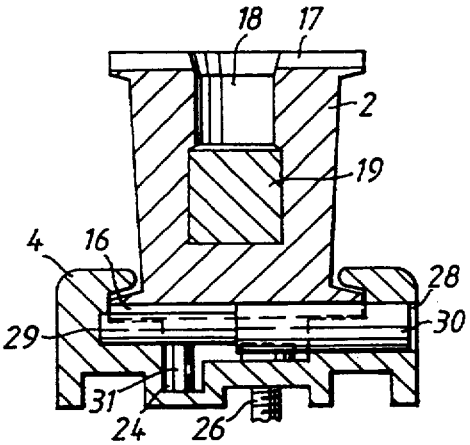

THEFT DETERRENT RELEASE DEVICE

BACKGROUND OF THE INVENTION

1. Technical Field

The present invention relates to a release device which is intended for releasing theft deterrent devices that are attached to theft attractive goods and which are of the kind defined.

2. Prior Art

Release devices of this kind are used to release theft deterrent devices that have been attached to attractive goods, for instance clothes, bags, handbags and other easily carried goods found in departmental stores and other shops, in order to deter the theft of such goods. A theft deterrent is intended to be attached to an article in a manner such that the deterrent can only be removed from the article concerned with the aid of a special deterrent release device. The purpose of such theft deterrents is to render the article unusable to all practical purposes should an attempt be made to remove the deterrent without the aid of the special deterrent release device intended therefor, the article can be rendered usable by tearing the article or by staining the article with a dye or some other suitable staining substance contained in a fragile ampoule which, when an attempt is made to remove the deterrent without using the correct deterrent release device, is fractured so as to release the staining substance and therewith stain the article, or damage the article in some other way. A theft deterrent of this kind is described in mere detail in International Patent Application PCT/SE91/00576.

At the present time, the devices used to release such theft deterrents are loosely placed on a sales counter or some other convenient support surface and are designed with sufficient extension on the underlying support surface and sufficient weight for the release device to have the stability that is essential for the theft deterrent to be removed easily and smoothly. In order to render the deterrent detaching part of the release device inaccessible to unauthorized persons, a separate locking unit can be mounted in or on said deterrent detaching part and firmly locked thereto, therewith preventing the theft deterrents from being released from the theft attractive articles to which they are attached by unauthorized persons. However, it has been found that the locking unit can be manipulated and released far too easily. Furthermore, this type of deterrent release device is awkward to handle when it is necessary to release theft deterrents from the inside of clothing, shoes, handbags and other goods.

OBJECTS OF THE INVENTION

The object of the present invention is to provide a theft deterrent release device which is flexible and easy to use even in not-readily reached and confined spaces, and which is so constructed as to be inaccessible for use by unauthorized persons.

This object is achieved in accordance with the invention with a release device as defined in the following claims.

BRIEF DESCRIPTION OF THE DRAWINGS

The invention will now be described in more detail with reference to an exemplifying embodiment thereof and also with reference to the accompanying drawings, in which:

FIG. 3 illustrates in principle the use of the release device for releasing a not-readily reached theft deterrent;

FIG. 4 is a perspective view of the release device in an inactive and locked state: and FIG. 5 is a cross-sectional view taken vertically through the centre axes of the deterrent detaching element, the locking groove and the insert lock of the deterrent release device illustrated in FIG. 2.

DETAILED DESCRIPTION OF THE PREFERRED EMBODIMENTS OF THE INVENTION

Figure 1:
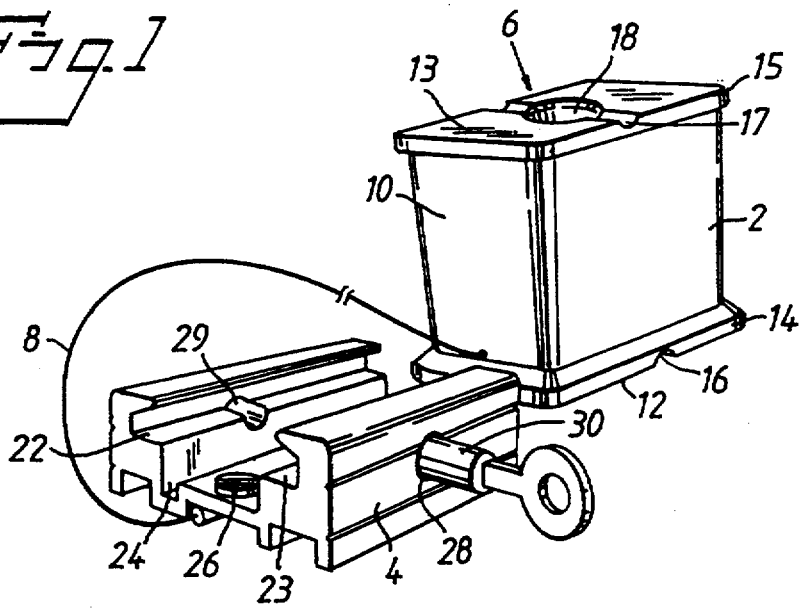
FIG. 1 is a perspective view of an inventive theft deterrent release device and shows the main units of the release device separated from one another.

The deterrent release device illustrated in FIG. 1 is comprised essentially of two main components, namely a deterrent detaching element 2 and a mount 4. The deterrent detaching element 2 and the mount 4 are preferably joined together by means of a wire 8 attached at each end to a respective one of said elements. The wire 8 has a length which, when the deterrent detaching element 2 is separated from the mount 4, enables the deterrent detaching element to be inserted into narrow, confined spaces in the goods or articles fitted with a theft deterrent and to release these deterrents from the goods in question, as illustrated in FIG. 3.

Figure 2:
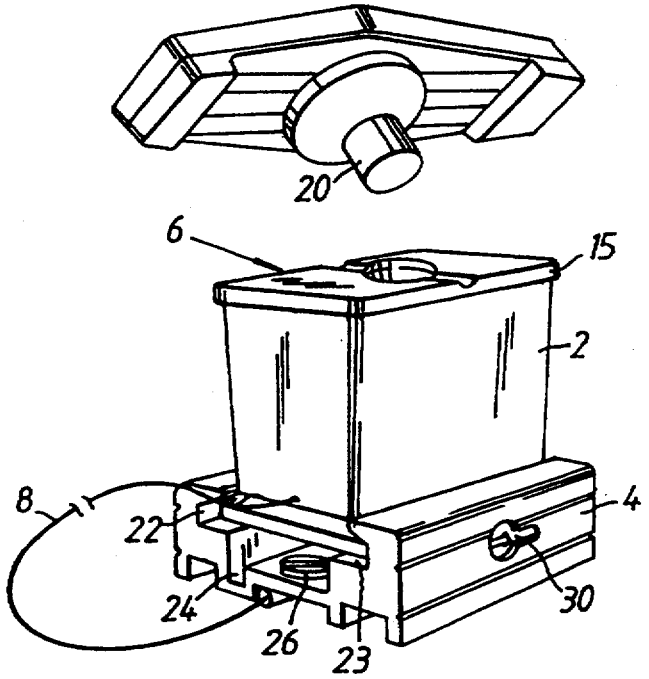
FIG. 2 is a perspective view of the release device which shows the device in its active state, and also shows part of a theft deterrent being inserted into the deterrent detaching element.

The deterrent detaching element 2 includes a generally box-like centre part 10 in which one end of the wire 8 is attached and which also houses a deterrent release element 19, for instance a magnet, as illustrated in FIG. 5. The two end surfaces of the centre part 10 each have a respective flat member 12, 13 whose edges project out beyond the centre part such as to form circumferentially extending flanges 14, 15 around both of said end parts. A transverse locking groove 16 is formed centrally on the end-surface 12, while a corresponding locking groove 17 is provided in the other flat end-surface 13, this latter end-surface also including a centrally positioned release element 6. The release means 6 comprises a circular blind hole 18 provided in the end-surface 13 and a release magnet 19 mounted on the bottom surface of the hole. The hole 18 is configured to receive the head 20 locked onto the illustrated theft deterrent, see FIGS. 2 and 3, said head being released from the main body of the theft deterrent by the magnet 19 in the release element 6, as shown in FIG. 2. The head 20 and the illustrated theft deterrent are merely shown by way of illustration and form no part of the present invention.

The mount 4 is comprised of an extruded cut-to-length profiled section whose cross-sectional shape is best seen from FIG. 5. The mount 4 has two mutually opposing tracks 22, 23 along the upper long sides of the profiled section. The flanges 14, 15 on the deterrent detaching element 2 are intended to run along the tracks 22, 23 and to be locked firmly therein with the aid of a locking device described in more detail herebelow. Also provided in the profiled section is a longitudinally extending locking groove 24. The mount 4 is intended to be screwed firmly to a sales counter or the like by means, for instance, of two penetrating screws 26. Attached to one end of the wire 8 is a dye-casted eyelet while the other end of the wire is secured to the deterrent detaching element 2. When the mount 4 is screwed to the underlying support: surface, the screw fasteners 26 are guided through the wire eyelet so as to hold the wire 8 between the mount: 4 and the underlying supporting surface, as shown in FIGS. 1–4.

The profiled section is also provided with recesses 28, 29 which accommodate a transverse insert lock 30, which is shown in a withdrawn and unlocked position in FIG. 1 and in an inserted and locked position in FIGS. 2 and 4. The insert lock is thus movably mounted in the mount and when inserted is located in the through-passing lock recess 28 and the inner lock recess 29. When the insert lock 30 is in its withdrawn position, the deterrent detaching element 2 can be moved in the mount 4. When the deterrent detaching element 2 is moved to a specific position in the mount 4, i.e. a position in which the position of the locking groove 16; 17 in the longitudinal direction of the profiled section coincides with the position of the lock recesses 28, 29, the insert lock 30 clan be inserted into the release device and therewith lock the deterrent detaching element against further movement in the mount. The deterrent detaching element is locked in this position by rotating the locking pin 31 of the insert lock down into the locking groove 24, with the aid of a key, so as to prevent with drawal of the insert lock from the profiled section, see FIG. 5.

The mount 4 is thus screwed firmly to a sales counter or the like while securing one end of the wire to the mount by means of a fastener screw. FIG. 2 illustrates the normal working state of the deterrent release device, in which the deterrent detaching element 2 is inserted in the running tracks 22, 23 of the mount to the position in which the locking groove 16 of the deterrent detaching element coincides with the position of the locking recesses 28, 29. In this position, the insert lock 30 can be inserted into the common space that is now formed by the locking groove 16 and the locking recesses 28, 29, whereby further movement of the deterrent detaching element 2 in the mount 4 is prevented. By turning the key in the lock so as to rotate the lock pin into the lock groove 24, the insert lock 30 is prevented from being withdrawn from the lock groove 16 and the lock recesses 28, 29. In this position, the deterrent release device is secured stably to the underlying support surface and can be used effectively by an authorized person to release theft deterrents from those articles for which payment has been received at the counter.

FIG. 3 illustrates the manner in which the deterrent detaching element 2 can be released from the mount 4 in order to be able to release theft deterrents which have been placed in narrow, confined spaces on the goods for practical reasons. Because the requisite stability of the inventive theft deterrent release device is achieved in the working position by the aforedescribed fixed installation, the deterrent detaching element 2 can be made small and light in weight, thereby enabling the element 2 when free of the mount 4 to be easily inserted into narrow and not-readily accessible spaces for the purpose of detaching a theft deterrent present therein. The deterrent detaching element 2 can readily be released from the mount 4 by an authorized person, by unlocking the insert lock with the aid of the key and withdrawing said lock. The deterrent detaching element can then be released from the mount 4 by sliding the element along the tracks 22, 23. The wire 8 connecting the element 2 to the mount 4 enables the deterrent detaching element to move freely while preventing unauthorized removal of the said element 2, see FIG. 3.

FIG. 4 illustrates how unauthorized persons can be denied access to the release part 6. According to the present invention, the deterrent detaching element 2 can be mounted in a second and inactive position in which the release part 6 is inaccessible. In this position, the deterrent detaching element 2 has been turned through 180°, such that the flat member 13 containing the circular release hole 18 faces down towards the mount 4. The longitudinally extending flanges 15 of the end-part have been pushed into the tracks 22, 23 in the mount 4 to the position in which the locking groove 17 coincides with the position of the locking recesses 28, 29. In this position, the insert lock 30 can be inserted and locked so as to firmly lock the deterrent detaching element 2 to the mount 4. The cylindrical release hole 18 cannot be reached in this second position, which renders the deterrent release device unusable to unauthorized persons. The fastener screws 26 are also inaccessible in this position, therewith preventing the release device from being removed from its place of attachment.

It will be understood that the invention is not restricted to the aforedescribed and illustrated exemplifying embodiment thereof and that several modifications are conceivable within the scope of the following claims. For instance, the key-controlled insert lock can be replaced with other types of locks, such as code locks or card-controlled locks. The centre part of the deterrent detaching element may have other forms than the illustrated box shape. Instead of being linearly displaceable in relation to one another, the deterrent detaching element and the mount may be rotatably movable in relation to one another and secured to one another with the aid of a bayonet connection, for instance. The running tracks may be provided on the deterrent detaching element instead of on the mount, and the flanges may therewith instead be mounted on the mount.

We claim:

1. A release device for releasing a theft deterrent for engagement to theft attractive goods, comprising a deterrent detaching element (2) having a release portion (6) arranged in a projecting end (13) thereof said release portion (6) being adapted to said theft deterrent and having a release function, a mount (4) which is securely mounted on an underlying support surface, locking means (14, 15, 16, 17, 22, 23, 30) in said deterrent detaching element and said mount for locking the deterrent detaching element and the mount to each other in either of two alternative positions, said deterrent detaching element (2) being releasably and lockably arranged in the mount (4) in a first position of said two alternative positions, in which the release portion (6) in the projecting end (13) is .accessible for activation of the release function, and said deterrent detaching element (2) being releasably and lockably arranged in the mount (4) in a second position of said two alternative positions, in which the release portion (6) in the projecting end (13) is inaccessible between the deterrent detaching element and the mount to prevent activation of the release function.

2. A release device according to claim 1, wherein the deterrent detaching element (2) has longitudinally extending flanges (14, 15) which are slidable in longitudinally extending tracks (22, 23) in the mount (4).

3. A release device according to claim 2, wherein the deterrent detaching element (2) comprises a center part (10) having a first flat element and a second flat element (12, 13) which project outside said center part to respectively form said longitudinally extending flanges (14, 15).

4. A release device according to claim 3, wherein said first flat element (12) of said deterrent detaching element (2) is provided with a first transverse locking groove (16) and said second flat element (13) of said deterrent detaching element (2) is provided with a second transverse locking groove (17) in a corresponding position with a centrally disposed apertured release part (6).

5. A release device according to claim 4, wherein activation of the release function is permitted in the first position wherein the first flat element (12) of the deterrent detaching element (2) is mounted in the longitudinally extending tracks (22, 23) of the mount (4), and in that activation of the release function is prevented in the second position in which the second flat element (13) of the deterrent detaching element (2) is lockably mounted in the longitudinally extending tracks (22, 23) of the mount (4).

6. A release device according to claim 1, wherein a wire (8) whose one end is attached to the deterrent detaching element (2) and whose other end is attached to the mount (4), joins said deterrent detaching element and said mount together.

7. A release device according to claim 4, wherein the mount (4) has an elongated profiled section having long sides on which locking recesses (28, 29) are formed to receive an insert lock (30) which can be inserted transversely into said mount (4).

8. A release device according to claim 7, wherein the deterrent detaching element (2) can be locked in the mount (4) in either of said two alternative positions in which the locking recesses (28, 29) respectively coincide transversely with either the first transverse locking groove or the second transverse locking groove (16;17).

9. A release device according to claim 8, wherein for the purpose of locking the deterrent detaching element (2) in the mount (4), there is provided an insert lock (30) which can be inserted into the locking recesses (28, 29) and either the first transverse locking groove or the second transverse locking groove (16; 17); said insert lock (30) having a locking pin (31) which is rotated into a locking groove (24) in the mount (4) by means of a key, so as to prevent the insert lock from being withdrawn from the release device and therewith releasing the deterrent detaching element (2) from the mount (4).

10. A release device according to claim 1, wherein the mount is secured to the underlying support surface by means of at least two penetrating screws (26), the heads of which are covered by the deterrent detaching element (2) when locked in either of said two alternative positions.

* * * * *